US011696648B2

(12) United States Patent
Huang

(10) Patent No.: US 11,696,648 B2
(45) Date of Patent: Jul. 11, 2023

(54) DOUBLE-LAYER INFLATABLE BED

(71) Applicant: BESTWAY INFLATABLES & MATERIAL CORP., Shanghai (CN)

(72) Inventor: Shuiyong Huang, Shanghai (CN)

(73) Assignee: BESTWAY INFLATABLES & MATERIAL CORP., Shanghai (CN)

( * ) Notice: Subject to any disclaimer, the term of this patent is extended or adjusted under 35 U.S.C. 154(b) by 22 days.

(21) Appl. No.: 17/503,909

(22) Filed: Oct. 18, 2021

(65) Prior Publication Data

US 2022/0133055 A1 May 5, 2022

(30) Foreign Application Priority Data

Oct. 30, 2020 (CN) ..... 202022456240.6

(51) Int. Cl.
*A47C 27/10* (2006.01)
*A47C 27/08* (2006.01)

(52) U.S. Cl.
CPC ..... *A47C 27/10* (2013.01); *A47C 27/087* (2013.01)

(58) Field of Classification Search
CPC ..... A47C 27/08; A47C 27/081; A47C 27/082; A47C 27/083; A47C 27/084; A47C 27/087; A47C 27/10
See application file for complete search history.

(56) References Cited

U.S. PATENT DOCUMENTS 6,839,922 B1 * 1/2005 Foggett ..... A47C 27/081 219/217
7,089,618 B1 * 8/2006 Metzger ..... A47C 27/087 5/709
8,656,540 B2 * 2/2014 Chen ..... A47C 27/081 5/710
11,503,920 B1 * 11/2022 Shi ..... A47C 27/10
2003/0200610 A1 * 10/2003 Wang ..... A47C 27/10 5/710
2004/0074004 A1 * 4/2004 Boso ..... A47C 27/088 5/710
2006/0265810 A1 * 11/2006 Wu ..... A47C 27/081 5/712

(Continued)

FOREIGN PATENT DOCUMENTS

CN 201253034 6/2009
EP 3524099 8/2019

OTHER PUBLICATIONS

Extended European Search Report dated Mar. 29, 2022 (Mar. 29, 2022) issued on related European patent application 21201951.7 by the European Patent Office.

*Primary Examiner* — David R Hare
*Assistant Examiner* — George Sun
(74) *Attorney, Agent, or Firm* — Dickinson Wright PLLC

(57) ABSTRACT

An inflatable bed is provided, comprising: a first piece, a middle piece having a middle master piece and an oblique ring piece having an inner edge connected to the middle master piece, and a second piece; a first lateral piece connected to the first piece and to an outer edge of the oblique ring piece; and a second lateral piece connected to the middle piece and to the second piece. A first air chamber is defined by the first piece, the middle piece, and the first lateral piece. A second air chamber is defined by the middle piece, the second piece, and the second lateral piece.

12 Claims, 7 Drawing Sheets

(56) References Cited

U.S. PATENT DOCUMENTS

| | | | | |
|---|---|---|---|---|
| 2007/0283499 | A1* | 12/2007 | Lin | A47C 27/081 5/713 |
| 2011/0265267 | A1* | 11/2011 | Wang | A47C 27/081 5/722 |
| 2013/0145560 | A1* | 6/2013 | Chen | A47C 27/082 5/711 |
| 2017/0196368 | A1* | 7/2017 | Liu | A47C 27/087 |
| 2021/0127849 | A1* | 5/2021 | Li | A47C 27/081 |
| 2021/0169232 | A1* | 6/2021 | Hou | A47C 27/087 |
| 2021/0196053 | A1* | 7/2021 | Li | A47C 27/10 |
| 2021/0259434 | A1* | 8/2021 | Wang | A47C 27/10 |

* cited by examiner

DOUBLE-LAYER INFLATABLE BED

CROSS-REFERENCE TO RELATED APPLICATION

This Application claims priority from Chinese Application CN202022456240.6, filed Oct. 30, 2020 in China, the disclosure of which is incorporated herein by reference in its entirety.

BACKGROUND

1. Field

Apparatuses and methods consistent with exemplary embodiments relate to inflatable products, and more particularly, to a double-layer inflatable bed.

2. Description of the Related Art

A double-layer inflatable bed may be formed by positioning an upper inflatable bed over a lower, independent, inflatable bed, and splicing the two together. That is to say, after an upper-layer inflatable bed and a lower-layer inflatable bed are inflated, respectively, they may be fixed to each other by connecting members. Since an upper air chamber and a lower air chamber of such a double-layer inflatable bed are mutually independent, such a bed uses more materials, requires a substantially complicated manufacturing process, has a high production cost, and requires a relatively cumbersome operation of inflatable splicing. Furthermore, when using such a double-layer inflatable bed, a user typically desires to put a bed cover on the bed. However, because there is no special structure, the bed cover often slips off, causing inconvenience.

SUMMARY

Example embodiments may address at least the above problems and/or disadvantages and other disadvantages not described above. Also, example embodiments are not required to overcome the disadvantages described above, and may not overcome any of the problems described above.

One or more example embodiments may provide a double-layer inflatable bed with improved performance, increased production efficiency, and reduced the production cost by optimizing a splicing process, and may prevent a bed cover from slipping off after being put on.

According to an aspect of an example embodiment, an inflatable bed is provided comprising: a first piece; a middle piece comprising a middle master piece and an oblique ring piece having an inner edge connected to the middle master piece; a second piece; a first lateral piece connected to the first piece and to an outer edge of the oblique ring piece, such that a first air chamber is defined by the first piece, the middle piece, and the first lateral piece; and a second lateral piece connected to the middle piece and to the second piece, such that a second air chamber is defined by the middle piece, the second piece, and the second lateral piece.

The inflatable bed may further comprise a tensioning structure disposed within the first air chamber and the second air chamber.

The inner edge of the oblique ring piece may be connected to a position on a first surface of the middle master piece, the position being spaced inward from an outer edge of the middle master piece; a first edge of the first lateral piece may be connected to an outer edge of the first piece, and a second edge of the first lateral piece may be connected to the outer edge of the oblique ring piece.

The oblique ring piece may be a first oblique ring piece and the middle piece may further comprise a second oblique ring piece having an inner edge connected to the middle master piece; a first edge of the second lateral piece may be connected to an outer edge of the second oblique ring piece, and a second edge of the second lateral piece may be connected to an outer edge of the second piece.

The tensioning structure may comprise: a first tensioning member connected to the first piece and the middle master piece; and a second tensioning member connected to the middle master piece and the second piece.

One of the first tensioning member and the second tensioning member may have one of a ring-shaped cross-sectional shape, an I-shaped cross-sectional shape, an X-shaped cross-sectional shape, and a Y-shaped cross-sectional shape.

The tensioning structure may be connected to the first piece, pass through an opening in the middle master piece, and be connected to the second piece.

The tensioning structure may comprise at least one tensioning member which has one of a ring-shaped cross-sectional shape, an I-shaped cross-sectional shape, an X-shaped cross-sectional shape, and a Y-shaped cross-sectional shape.

A plurality of vent holes may be formed in the middle master piece such that the first air chamber and the second air chamber are in communication through the plurality of vent holes.

The inflatable bed may further comprise a first oblique ring tape connected to the first piece and the first lateral piece.

The inflatable bed may further comprise a second oblique ring tape connected to the second piece and the second lateral piece.

According to an aspect of another example embodiment, an inflatable bed is provided comprising: a top piece; a bottom piece; and a middle piece comprising a middle master piece and an oblique ring piece having an inner edge connected to a position on the middle master piece inward from an outer edge of the middle master piece; an upper lateral piece having an upper edge connected to an outer edge of the top piece and a lower edge connected to the middle piece, thereby defining an upper air chamber; a lower lateral piece having an upper edge connected to the middle piece and a lower edge connected to an outer edge of the bottom piece, thereby defining a lower air chamber; and a tensioning structure disposed in the upper air chamber and in the lower air chamber and connected to the top piece and the bottom piece; wherein a first one of the lower edge of the upper lateral piece and the upper edge of the lower lateral piece is connected to an outer edge of the oblique ring piece and a second one of the lower edge of the upper lateral piece and the upper edge of the lower lateral piece is connected to the position on the middle master piece.

An inflatable bed according to one or more example embodiments described herein may have a simple structure, a low cost, and may be convenient to use. Furthermore, a connection portion between an upper-layer inflatable bed and a lower-layer inflatable bed according to one or more example embodiments described herein, may be recessed inward after inflation such that it may be convenient to put on a bed cover.

BRIEF DESCRIPTION OF THE DRAWINGS

The above and/or other aspects will become apparent and more readily appreciated from the following description of example embodiments, taken in conjunction with the accompanying drawings, in which.

DETAILED DESCRIPTION

Figure 1:
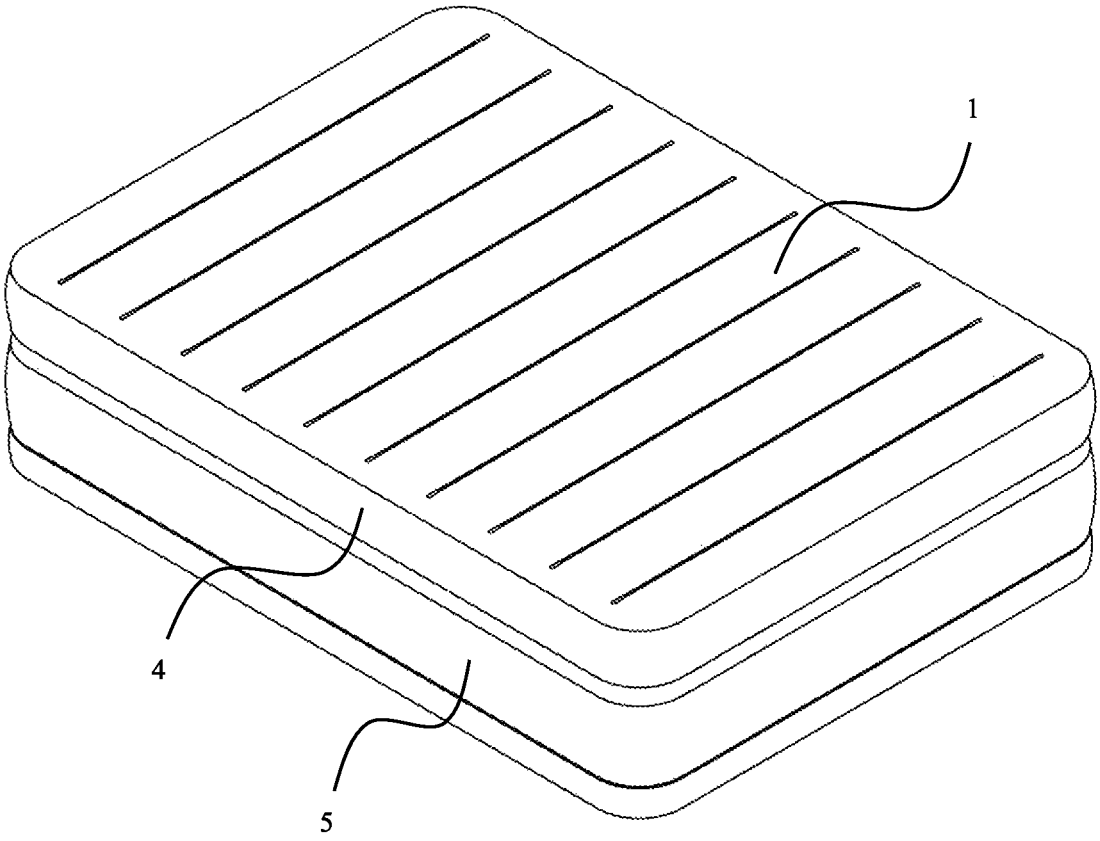
FIG. 1 is a schematic perspective view of a double-layer inflatable bed according to an example embodiment.
Figure 2:
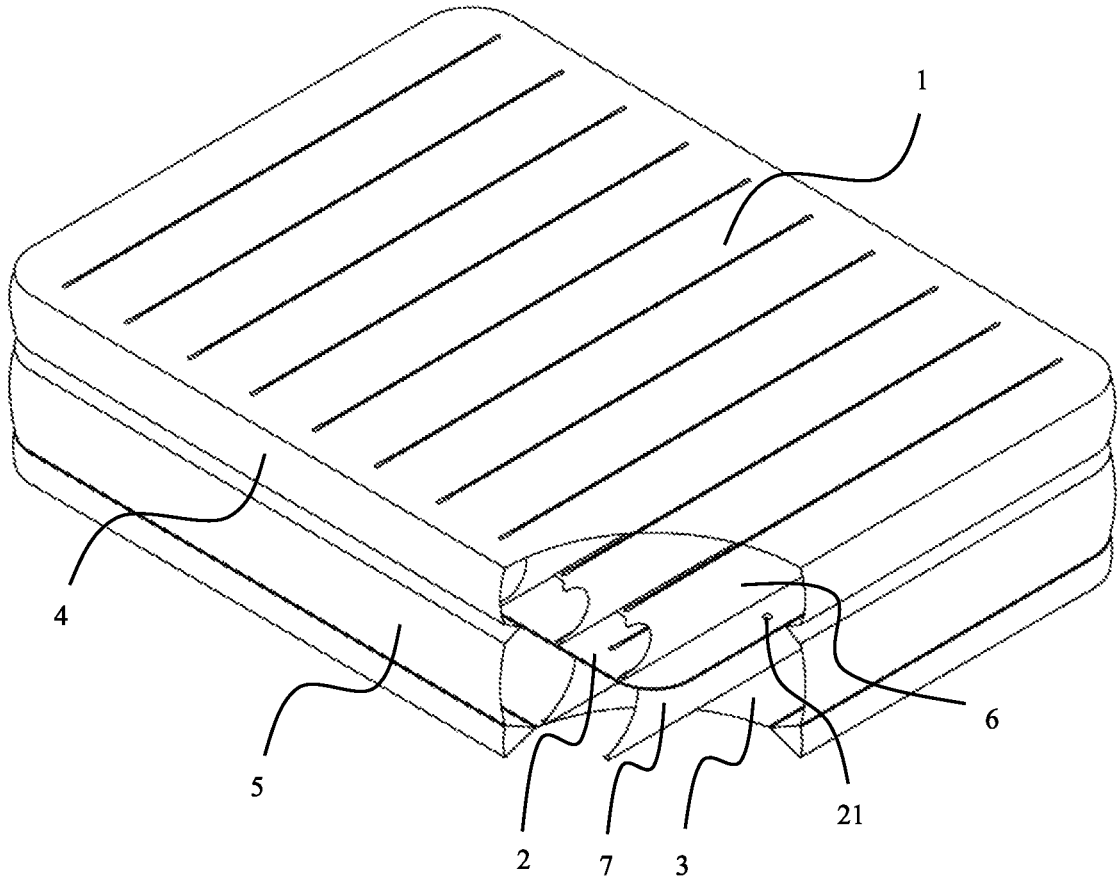
FIG. 2 is a partial cutaway schematic view of the double-layer inflatable bed of FIG. 1.
Figure 3:
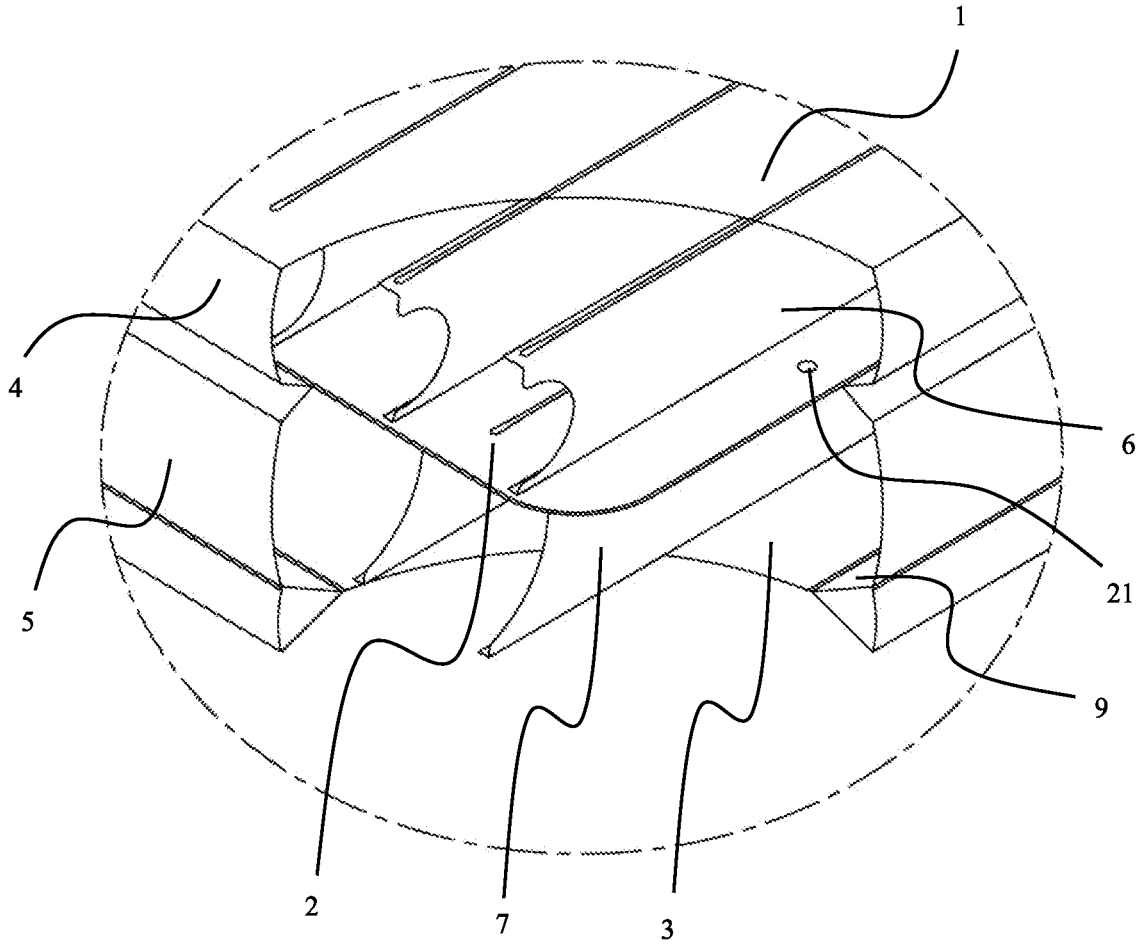
FIG. 3 is a partially enlarged schematic view of the double-layer inflatable bed of FIG. 2.
Figure 4:
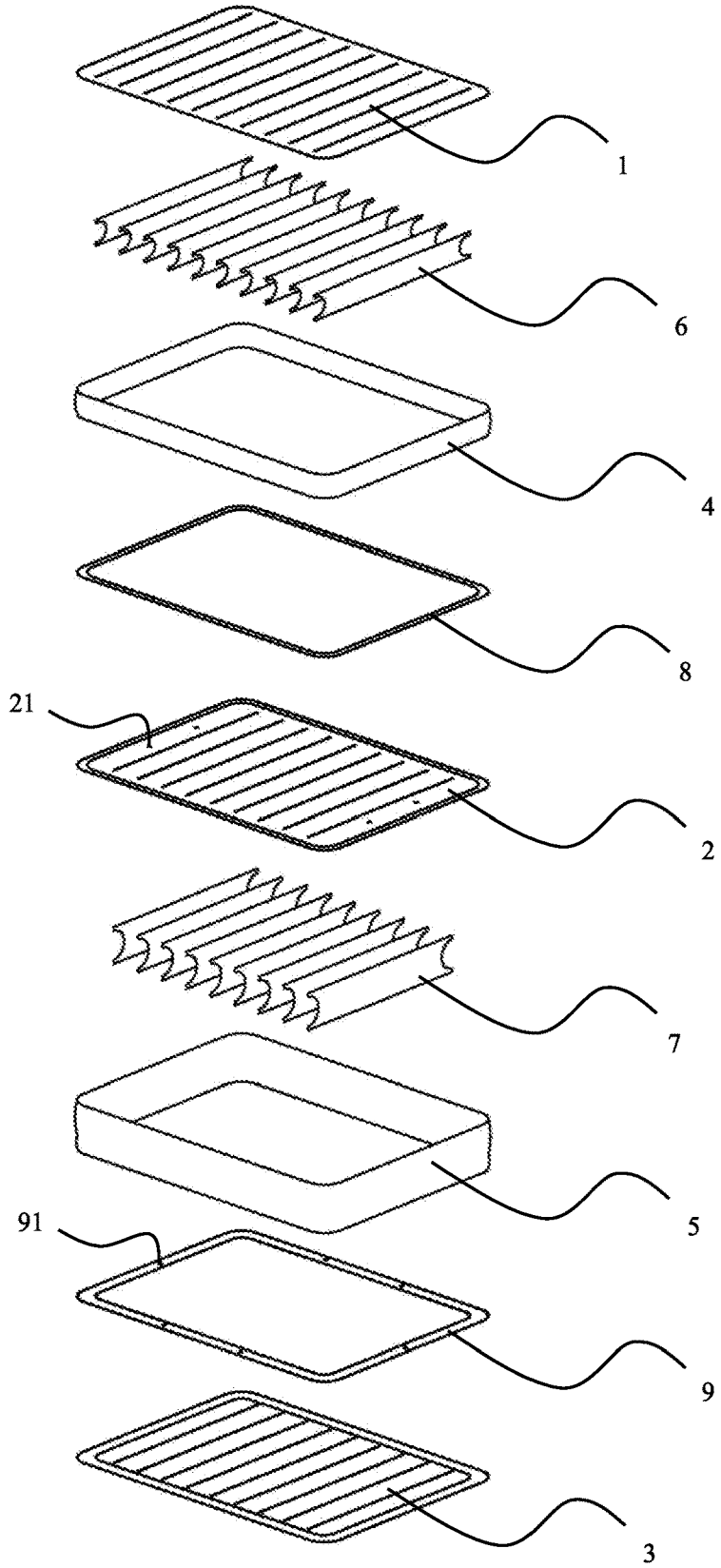
FIG. 4 is an exploded schematic view of the double-layer inflatable bed of FIG. 1.
Figure 5:
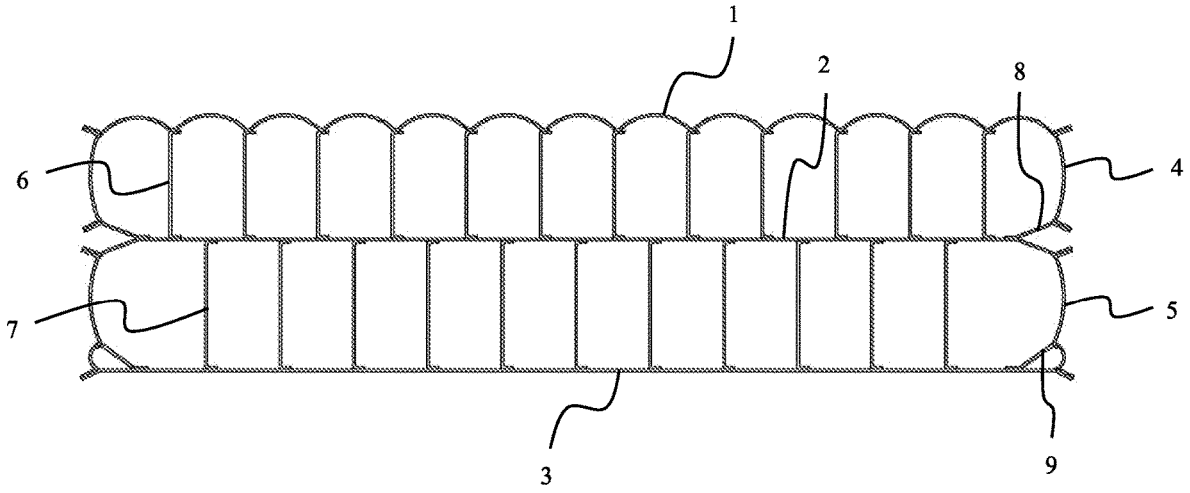
FIG. 5 is a cross-sectional schematic view of the double-layer inflatable bed of FIG. 1.
Figure 6:
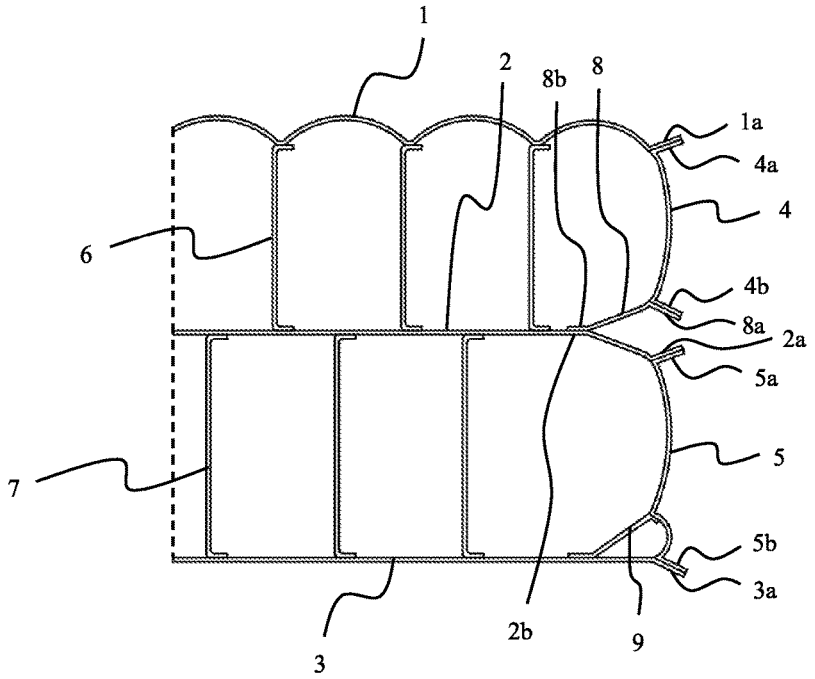
FIG. 6 is a partially enlarged schematic view of the double-layer inflatable bed of FIG. 5.

Reference will now be made in detail to example embodiments which are illustrated in the accompanying drawings, wherein like reference numerals refer to like elements throughout. In this regard, the example embodiments may have different forms and may not be construed as being limited to the descriptions set forth herein.

It will be understood that the terms "include," "including", "comprise, and/or "comprising," when used in this specification, specify the presence of stated features, integers, steps, operations, elements, and/or components, but do not preclude the presence or addition of one or more other features, integers, steps, operations, elements, components, and/or groups thereof.

It will be further understood that, although the terms "first," "second," "third," etc., may be used herein to describe various elements, components, regions, layers and/or sections, these elements, components, regions, layers and/or sections may not be limited by these terms. These terms are only used to distinguish one element, component, region, layer or section from another element, component, region, layer or section.

Expressions of orientation, as used herein, such as "top", "bottom", "upper" and "lower" etc., are used for explaining structural positions of various components, and are not absolute but relative. Expressions of orientation are appropriate when the various components are arranged as shown in the figures, but should change accordingly when the positions of the various components in the figures change.

As used herein, the term "and/or" includes any and all combinations of one or more of the associated listed items. Expressions such as "at least one of," when preceding a list of elements, modify the entire list of elements and do not modify the individual elements of the list.

Various terms are used to refer to particular system components. Different companies may refer to a component by different names—this document does not intend to distinguish between components that differ in name but not function.

Matters of these example embodiments that are obvious to those of ordinary skill in the technical field to which these exemplary embodiments pertain may not be described here in detail.

As shown in FIGS. 1 to 6, a double-layer inflatable bed according to an example embodiment comprises a top piece 1, a middle piece, a bottom piece 3, an upper lateral piece 4, a lower lateral piece 5, and a tensioning structure. The middle piece comprises a middle master piece 2 and an oblique ring piece 8. In the context of descriptions with respect to the figures, a number of elements are referred to as such, using the modifiers "top," "bottom," "upper," and "lower," herein, for ease of understanding. However, it should be noted that these elements may alternately be referred to by replacing any of the terms "upper," "lower," "top," and "bottom" with either of the terms "first" and "second."

The top piece 1, the middle master piece 2, and the bottom piece 3 are substantially parallel to each other, allowing for natural variations in orientation due to inflation, material, etc. The top piece 1, the middle master piece 2, and the bottom piece 3 are in sequence from top to bottom to form a double-layer structure. The oblique ring piece 8 is ring-shaped, and is connected to an upper surface of the middle master piece 2, at a position 2*b* spaced from an outer edge 2*a* of the middle master piece 2, and extends outward. The upper lateral piece 4 and the lower lateral piece 5 are each ring-shaped. An upper edge 4*a* of the upper lateral piece 4 is connected to an outer edge 1*a* of the top piece 1, and a lower edge 4*b* of the upper lateral piece 4 is connected to an outer edge 8*a* of the oblique ring piece 8. Thus, an upper-layer air chamber is defined by: the upper piece 1, connected at its outer edge 1*a* to the upper lateral piece; the upper lateral piece 4, connected at its upper edge 4*a* to the upper piece 1 and at its lower edge 4*b* to the oblique ring piece 8; the oblique ring piece 8, connected at its outer edge 8*a* to the upper lateral piece 4 and at its inner edge 8*b* to the middle master piece; and the middle master piece 2, connected at a position 2*b* to the oblique ring piece 8. An upper edge 5*a* of the lower lateral piece 5 is connected to the outer edge 2*a* of the middle master piece 2, and a lower edge 5*b* of the lower lateral piece 5 is connected to an outer edge 3*a* of the bottom piece 3 to form a lower-layer air chamber. The middle master piece 2 is may have a plurality of vent holes 21 formed therein to enable the upper-layer air chamber and the lower-layer air chamber to be in communication with each other. The upper-layer air chamber and the lower-layer air chamber may be symmetrically or uniformly arranged, which arrangement may facilitate inflation and deflation operations of the double-layer inflatable bed.

Since the upper lateral piece 4 is connected to the middle master piece 2 by means of the oblique ring piece 8 at the position 2*b*, which is inward by a certain distance as compared with the outer edge 2*a* of the middle master piece 2, the resulting connection between the upper-layer inflatable bed and the lower-layer inflatable bed is recessed inward once the bed is inflated, such that it may be convenient for a bed cover to be put on and kept on the upper-layer inflatable bed.

A tensioning structure may be provided within each of the upper-layer air chamber and the lower-layer air chamber for tensioning the respective air chamber and limit its excessive expansion. In the example embodiment as shown, the tensioning structure comprises a plurality of substantially parallel upper-layer straight tensioning members 6 which are each connected to the top piece 1 and to the middle master piece 2, and a plurality of parallel lower-layer straight tensioning members 7 which are each connected to the middle master piece 2 and to the bottom piece 3, wherein each of the upper-layer straight tensioning members 6 and the lower-layer straight tensioning members 7 are substantially I-shaped and are arranged in a staggered manner in a vertical direction, such that, for example, the lower edge of one of the upper-layer straight tensioning members 6 is connected to the middle master piece 2 between the connections of the upper edges of two adjacent lower-layer straight tensioning members 7. Of course, this particular example of tensioning members is merely an example, and the upper-layer straight tensioning members 6 and the lower-layer straight tensioning members 7 may comprise any of a number of other types of tensioning members suitable for an inflatable product, such as, but not limited to: ring-shaped tensioning members, X-shaped tensioning members, and Y-shaped tensioning members.

According to an example variation not shown, the tensioning structure may comprise a plurality of parallel double-layer straight tensioning members connecting the top piece 1 and the bottom piece 3 through the middle master piece 2. That is to say, the middle master piece 2 may be provided with a plurality of orifices, the number and the position of the orifices corresponding to a number and position of double-layer straight tensioning members, thus these double-layer straight tensioning members may pass through corresponding orifices to connect the top piece 1 and the bottom piece 3. Alternately, the double-layer straight tensioning members may comprise any of a number of other types of tensioning members suitable for an inflatable product, such as, but not limited to ring-shaped tensioning members, I-shaped tensioning members, X-shaped tensioning members, and or Y-shaped.

The tensioning structure may further comprise at least one ring-shaped upper-layer oblique ring piece (not shown) for connecting the top piece 1 to the upper lateral piece 4, wherein the upper-layer oblique ring piece can have at least one vent hole formed therethrough. An arrangement of the upper-layer oblique ring piece may not only further optimize mechanical properties of the double-layer inflatable bed, but may also effectively increase a usable area of the double-layer inflatable bed by limiting excessive expansion of the outer edge of the top piece 1.

The tensioning structure may further comprise at least one ring-shaped lower-layer oblique ring piece 9 connecting the bottom piece 3 and the lower lateral piece 5, wherein the lower-layer oblique ring piece 9 may have at least one vent hole 91 formed thereon. This arrangement of the lower-layer oblique ring piece 9 may further optimize mechanical properties of the double-layer inflatable bed, and may also make the double-layer inflatable bed more stable by increasing the road holding of the outer edge of the bottom piece 3 during use such that the double-layer inflatable bed is not easy to roll over.

One or more of the components described above with respect to an example double-layer inflatable bed, including, but not limited to the top piece 1, the middle master piece 2, the bottom piece 3, the upper lateral piece 4, the lower lateral piece 5, the upper-layer straight tensioning member tape 6, the lower-layer straight tensioning member 7, the middle ring piece 8, the upper-layer oblique ring piece, and the lower-layer oblique ring piece 9, may all be made of PVC (polyvinyl chloride) sheets, for example, and any two or more components may be connected, for example by high-frequency welding (butt fusion), to ensure connection strength and sealing of the air chamber.

Figure 7:
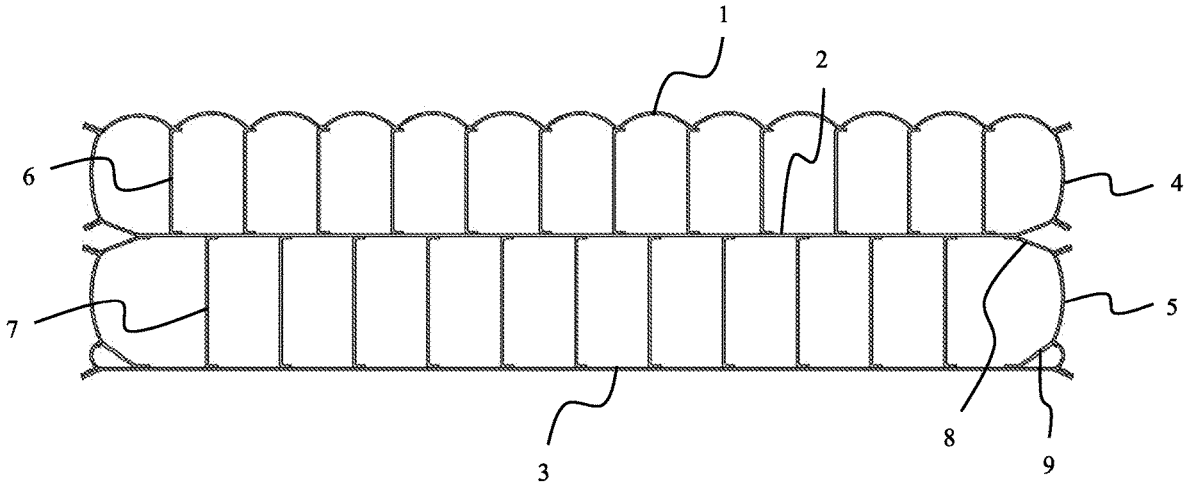
FIG. 7 is a cross-sectional schematic view of a double-layer inflatable bed according to another example embodiment.
Figure 8:
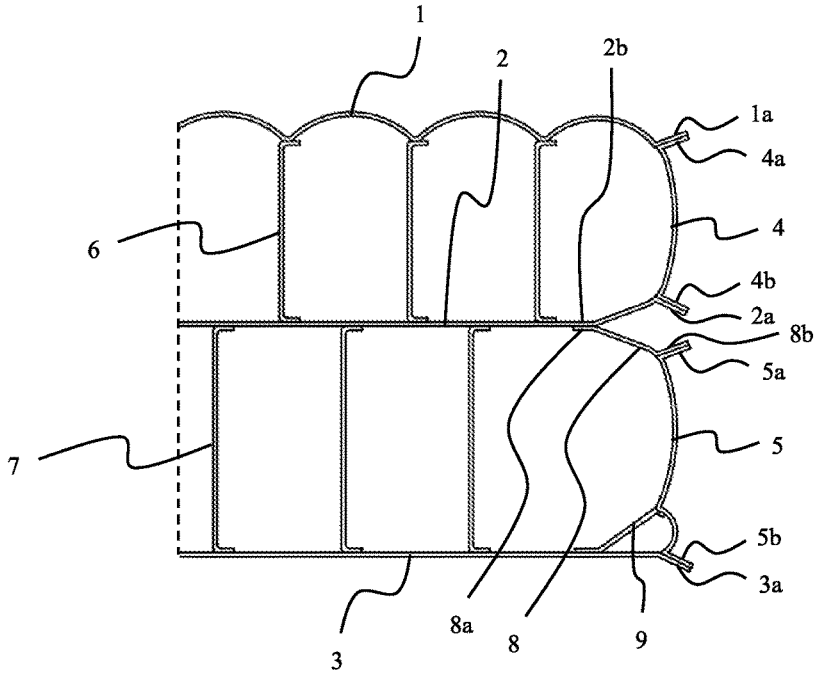
FIG. 8 is a partially enlarged schematic view of the double-layer inflatable bed of FIG. 7.

As shown in FIG. 7 and FIG. 8, the integral construction of the double-layer inflatable bed according to embodiment II is similar to that of the double-layer inflatable bed according to embodiment I, so the similarities are not repeated. A difference between this example embodiment and the previously-described example embodiment is that the arrangement of the oblique ring piece 8 is different. According to this example embodiment, the oblique ring piece 8 is connected to the position 2*b* on a lower surface of the middle master piece 2, rather than on the upper surface of the middle master piece, and extends outward.

More particularly, the upper edge 4*a* of the upper lateral piece 4 is connected to the outer edge 1*a* of the top piece 1, and the lower edge 4*b* of the upper lateral piece 4 is connected to the outer edge 2*a* of the middle master piece 2 to form the upper-layer air chamber. The upper edge 5*a* of the lower lateral piece 5 is connected to the position 2*b* of the middle master piece 2 by means of the oblique ring piece 8. The lower edge 5*b* of the lower lateral piece 5 is connected to the outer edge 3*a* of the bottom piece 3 to form the lower-layer air chamber. The outer edge 8*a* of the oblique ring piece 8 is connected to the position 2*b* of the middle master piece 2, and the inner edge 8*b* of the oblique ring piece 8 is connected to the upper edge 5*a* of the lower lateral piece 5.

Due to the lower lateral piece 5 being connected to the middle master piece 2 by means of the oblique ring piece 8 at the position 2*b*, which is inward by a certain distance compared with the outer edge 2*a* of the middle master piece 2, a connection portion between the upper-layer inflatable bed and the lower-layer inflatable bed is recessed inward once inflated, such that it is convenient for a bed cover to be put on and kept on the upper-layer inflatable bed.

Figure 9:
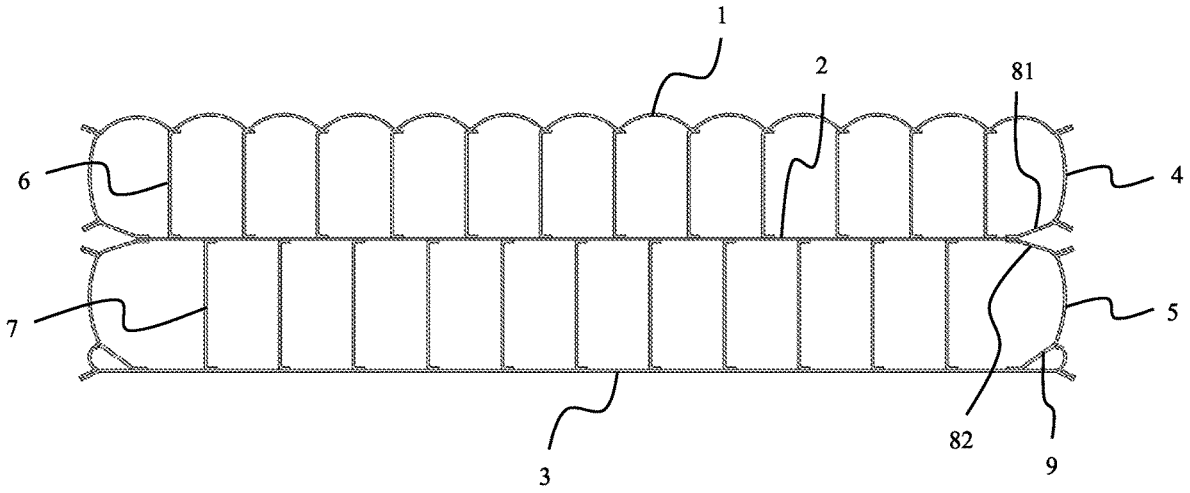
FIG. 9 is a cross-sectional schematic view of a double-layer inflatable bed according to another example embodiment.
Figure 10:
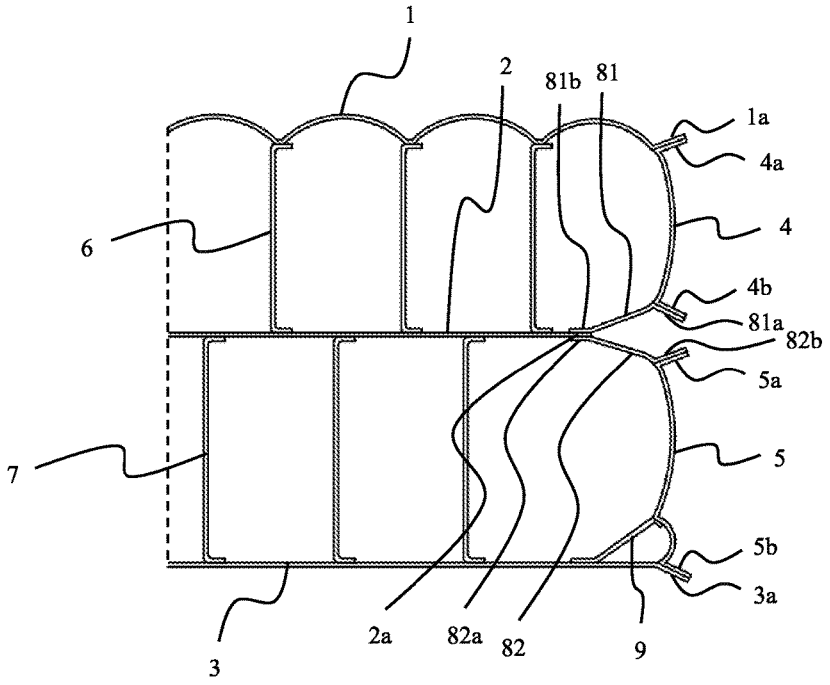
FIG. 10 is a partially enlarged schematic view of the double-layer inflatable bed of FIG. 9.

As shown in FIG. 9 and FIG. 10, the integral construction of a double-layer inflatable bed according to another example embodiment is similar to that of the double-layer inflatable bed according to the above-described example embodiments except that there are two oblique ring pieces, comprising an upper oblique ring piece 81 and a lower oblique ring piece 82. The upper oblique ring piece 81 is connected to the outer edge 2*a* of the upper surface of the middle master piece 2. The lower oblique ring piece 81 is connected to the outer edge 2*a* of the lower surface of the middle master piece 2.

The upper edge 4*a* of the upper lateral piece 4 is connected to the outer edge 1*a* of the top piece 1, and the lower edge 4*b* of the upper lateral piece 4 is connected to the outer edge 2*a* of the middle master piece 2 by means of the upper oblique ring piece 81 to form the upper-layer air chamber. More specifically, the outer edge 81*a* of the upper oblique ring piece 81 is connected to the lower edge 4*b* of the upper lateral piece 4, and the inner edge 81*b* of the upper oblique ring piece 81 is connected to the outer edge 2*a* of the upper surface of the middle master piece 2. The upper edge 5*a* of the lower lateral piece 5 is connected to the outer edge 2*a* of the middle master piece 2 by means of the lower oblique ring piece 82, and the lower edge 5*b* of the lower lateral piece 5 is connected to the outer edge 3*a* of the bottom piece 3 to form the lower-layer air chamber. More particularly, the inner edge 82*a* of the lower oblique ring piece 82 is connected to the outer edge 2*a* of the lower surface of the middle master piece 2, and the outer edge 82*b* of the lower oblique ring piece 82 is connected to the upper edge 5*a* of the lower lateral piece 5.

Since the middle master piece 2 is indirectly connected to the upper lateral piece 4 and to the lower lateral piece 5, respectively, by the upper oblique ring piece 81 and the lower oblique ring piece 82, the connection between the upper-layer inflatable bed and the lower-layer inflatable bed may be recessed inward once inflated, such that it is convenient for a bed cover to be put on and kept on the upper-layer inflatable bed.

It may be understood that the exemplary embodiments described herein may be considered in a descriptive sense only and not for purposes of limitation. Descriptions of features or aspects within each exemplary embodiment may be considered as available for other similar features or aspects in other exemplary embodiments.

While exemplary embodiments have been described with reference to the figures, it will be understood by those of ordinary skill in the art that various changes in form and details may be made therein without departing from the spirit and scope as defined by the following claims.

What is claimed is:

1. An inflatable bed, comprising:

a first piece;

a middle piece comprising a middle master piece and an oblique ring piece having an inner edge connected to the middle master piece, wherein the middle master piece consists of a single, unitary, sheet;

a second piece;

a first lateral piece connected to the first piece and to an outer edge of the oblique ring piece, such that a first air chamber is defined by the first piece, the middle piece, and the first lateral piece; and a second lateral piece connected to the middle piece and to the second piece, such that a second air chamber is defined by the middle piece, the second piece, and the second lateral piece.

2. The inflatable bed according to claim 1, further comprising a tensioning structure disposed within the first air chamber and the second air chamber.

3. The inflatable bed according to claim 1, wherein:

the inner edge of the oblique ring piece is connected to a position on a first surface of the middle master piece, the position being spaced inward from an outer edge of the middle master piece;

a first edge of the first lateral piece is connected to an outer edge of the first piece, and a second edge of the first lateral piece is connected to the outer edge of the oblique ring piece.

4. The inflatable bed according to claim 3, wherein:

the oblique ring piece is a first oblique ring piece and the middle piece further comprises a second oblique ring piece having an inner edge connected to the middle master piece;

a first edge of the second lateral piece is connected to an outer edge of the second oblique ring piece, and a second edge of the second lateral piece is connected to an outer edge of the second piece.

5. The inflatable bed according to claim 2, wherein the tensioning structure comprises:

a first tensioning member connected to the first piece and the middle master piece; and a second tensioning member connected to the middle master piece and the second piece.

6. The inflatable bed according to claim 5, wherein one of the first tensioning member and the second tensioning member has one of a ring-shaped cross-sectional shape, an I-shaped cross-sectional shape, an X-shaped cross-sectional shape, and a Y-shaped cross-sectional shape.

7. The inflatable bed according to claim 2, wherein the tensioning structure is connected to the first piece, passes through an opening in the middle master piece, and is connected to the second piece.

8. The inflatable bed according to claim 7, wherein the tensioning structure comprises at least one tensioning member which has one of a ring-shaped cross-sectional shape, an I-shaped cross-sectional shape, an X-shaped cross-sectional shape, and a Y-shaped cross-sectional shape.

9. The inflatable bed according to claim 1, wherein a plurality of vent holes are formed in the middle master piece such that the first air chamber and the second air chamber are in communication through the plurality of vent holes.

10. The inflatable bed according to claim 1, further comprising a first oblique ring tape connected to the first piece and the first lateral piece.

11. The inflatable bed according to claim 10, further comprising a second oblique ring tape connected to the second piece and the second lateral piece.

12. An inflatable bed comprising:

a top piece;

a bottom piece; and a middle piece comprising a middle master piece and an oblique ring piece having an inner edge connected to a position on the middle master piece inward from an outer edge of the middle master piece, wherein the middle master piece consists of a single, unitary, sheet;

an upper lateral piece having an upper edge connected to an outer edge of the top piece and a lower edge connected to the middle piece, thereby defining an upper air chamber;

a lower lateral piece having an upper edge connected to the middle piece and a lower edge connected to an outer edge of the bottom piece, thereby defining a lower air chamber; and a tensioning structure disposed in the upper air chamber and in the lower air chamber and connected to the top piece and the bottom piece;

wherein a first one of the lower edge of the upper lateral piece and the upper edge of the lower lateral piece is connected to an outer edge of the oblique ring piece and a second one of the lower edge of the upper lateral piece and the upper edge of the lower lateral piece is connected to the position on the middle master piece.

* * * * *